United States Patent [19]

Gantner

[11] 4,078,349

[45] Mar. 14, 1978

[54] INSULATION ROOF LINING

[76] Inventor: Hans Gantner, CH-8888 Heiligkreuz-Mels, Switzerland

[21] Appl. No.: 762,352

[22] Filed: Jan. 25, 1977

[30] Foreign Application Priority Data

Feb. 6, 1976 Switzerland ..... 1466/76

[51] Int. Cl.[2] ..... E04D 1/28

[52] U.S. Cl. ..... 52/409; 52/478; 52/540

[58] Field of Search ..... 52/309.9, 309.11, 478, 52/409, 404, 540, 518

[56] References Cited

U.S. PATENT DOCUMENTS

| | | | |
|---|---|---|---|
| 1,798,380 | 3/1931 | Martin | 52/478 X |
| 2,029,352 | 2/1936 | Beckwith | 52/409 X |
| 2,153,015 | 4/1939 | Voigt | 52/409 |
| 2,175,226 | 10/1939 | Slayter | 52/409 |
| 3,095,671 | 7/1963 | Fink et al. | 52/409 X |
| 3,496,689 | 2/1970 | Nerem | 52/309.11 X |
| 3,782,049 | 1/1974 | Sachs | 52/309.9 |

FOREIGN PATENT DOCUMENTS

| | | | |
|---|---|---|---|
| 741,051 | 8/1966 | Canada | 52/404 |
| 1,166,799 | 11/1958 | France | 52/540 |
| 1,171,591 | 6/1964 | Germany | 52/478 |
| 913,557 | 12/1962 | United Kingdom | 52/540 |

*Primary Examiner*—Alfred C. Perham
*Attorney, Agent, or Firm*—Pollock, Vande Sande & Priddy

[57] ABSTRACT

The invention provides an insulated roof lining consisting of rectangular roofing boards supported on rafters with each board consisting of a hard covering plus a loose insulation layer connected therewith plus a reinforcing body embedded in the insulation layer and firmly connected with the covering. The covering projects laterally, at two sides starting from a corner of the layer, beyond the edges of the layer and partly overlaps the adjoining roofing boards.

2 Claims, 5 Drawing Figures

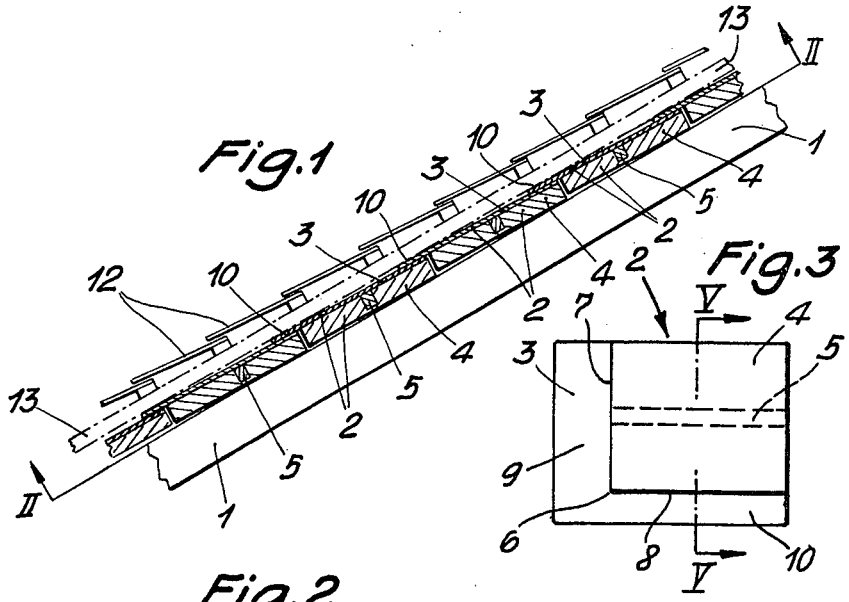
Fig.1
Fig.3
13
II
3
10
1
4
5
2
12
7
V
6
8
9
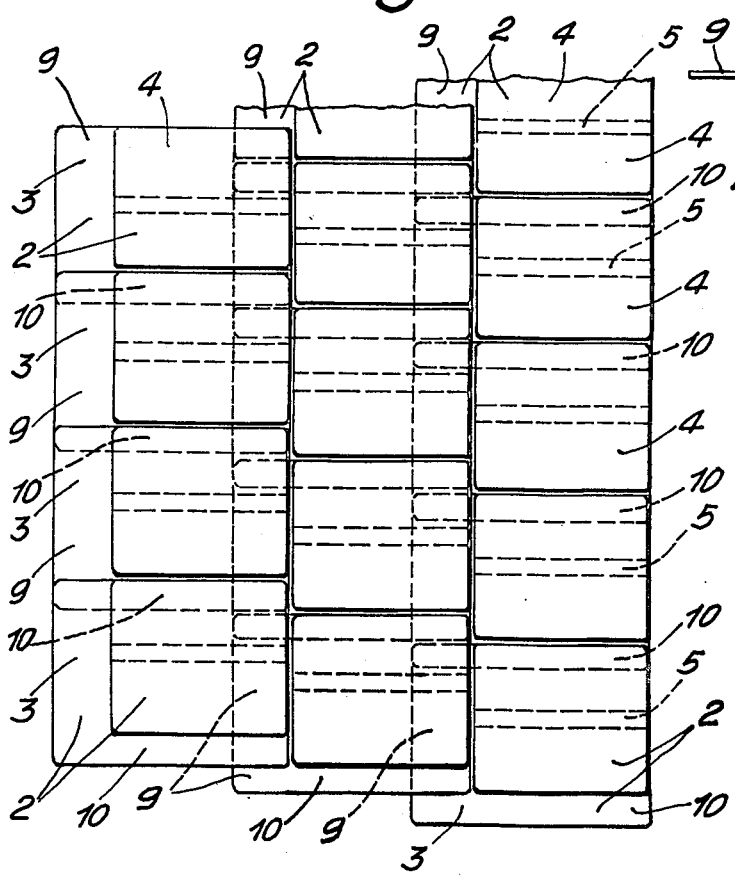
Fig.2
9
4
2
5
3
10
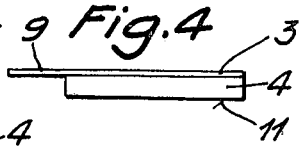
Fig.4
9
3
4
11
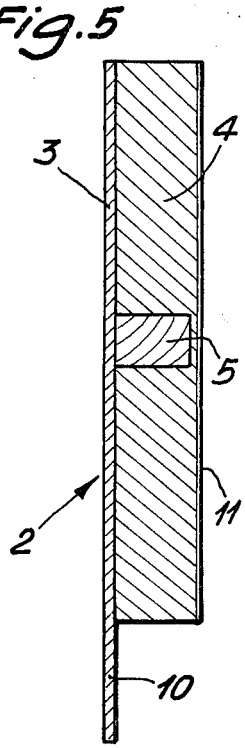
Fig.5
3
4
5
2
11
10

INSULATION ROOF LINING

It is known to provide roofs with insulation roof lining fabricated of roofing fabric mats, mineral fibre boards, glass-fibre boards etc. For the construction of an insulation roof lining, mineral fibre insulation boards provided with a hard covering such as hard board have already been used. In the event of a damaged top roof, the roof lining constructed in the manner known hitherto could not prevent the penetration of water.

The present invention relates to an insulation roof lining having rectangular roofing boards arranged on rafters, these roofing boards consisting of a hard covering, a loose insulation layer connected with the covering and a reinforcing body embedded in the insulation layer and firmly connected with the hard covering, with the hard covering projecting, at two sides starting from one corner of the insulation layer, beyond the edge of the insulation layer and partly overlapping the adjoining roofing boards.

BRIEF DESCRIPTION OF THE DRAWINGS

An embodiment of the invention given by way of example is shown in the accompanying drawings in which:

FIG. 1 is a sectional view of a roof incorporating the insulation roof lining of the present invention;

FIG. 2 is an underplan view of the insulation roof lining, taken on the line II—II of FIG. 1;

FIG. 3 is an underplan view of one of the roofing boards used for the construction of the roof lining;

FIG. 4 is a front elevation of the roofing board shown in FIG. 3, and

FIG. 5 is a sectional view of the roofing board taken on the line V—V of FIG. 3.

DESCRIPTION OF THE PREFERRED EMBODIMENT

The illustrated insulation roof lining comprising a plurality of roofing boards 2 arranged on rafters 1. Each insulation board 2 consists of a rectangularly shaped hard board 3, preferably an oil-hardened wood-fibre board, a rectangularly shaped loose insulation layer 4 connected to boards, and an elongated reinforcing body 5 consisting of a wooden or metal square bar, said reinforcing body 5 being embedded in the insulation layer 4 and being firmly connected with the hard board 3. One corner of rectangular layer 4 is coincident with one corner of hard board 3, and the edges of said layer 4 and board 3 adjacent said corner are substantially colinear with one another as illustrated. The size of rectangular board 3 is larger than that of rectangular insulation layer 4, however, so that hard board 3 projects, at two sides 7, 8 starting from the corner 6 of the insulation layer, laterally beyond the edges of the insulation layer 4. The plurality of boards 2 are arranged in such a way that the laterally projecting parts 9, 10 of each board partly overlap the adjacent board abutting at the side or at the bottom (FIGS. 1 and 2). An aluminum foil layer 11 is glued onto that side of the insulation layer which is turned away from the hard board 3, or onto its underside.

The insulation layer 4 consists of natural or synthetic mineral fibres which are normally produced of raw minerals such as glass, slag, stone, quartz, ceramics etc. This type of insulation layer therefore guarantees high protection against sound, loss of heat, cold and fire.

The reinforcing strip 5 in each board increases the supporting capacity of each insulation roof lining. The reinforcing strip 5 may be glued or nailed to its associated hard board 3. As shown in FIG. 1, the reinforcing strip 5 is embedded transversely in the center of the associated insulation layer 4. Reference 12 of FIG. 1 denotes an asbestos-cement roof. The latter is laid on counter-laths 13 which are fixed on the insulation roof lining.

I claim:

1. An insulated roof lining comprising a plurality of like-constructed roofing units supported on rafters in closely adjacent relation to one another, each of said roofing units comprising a planar board of rectangular shape fabricated of nonyielding hard material, a comparatively soft rectangular layer of fibrous insulation material attached to said board, said fibrous layer defining a pair of opposing substantially parallel fibrous faces of rectangular shape spaced from one another by the intervening fibrous material of said layer to define a thickness of said fibrous layer which is greater than the thickness of said board, one of said faces of said fibrous layer being in direct engagement with the inner surface of said board, the edge surfaces of said fibrous layer between said opposing faces thereof extending transverse to the plane of said board and being unconfined to permit the fibrous edge surfaces of each roofing unit to directly abut the fibrous edge surfaces of adjacent ones of said roofing units in said insulated roof lining, one corner of said rectangular fibrous layer being coincident with one corner of said planar board, the two edge surfaces of said layer and of said board adjacent to said one corner of said layer and board respectively being colinear with one another, the lateral dimensions of each rectangular face of said fibrous later being less than the lateral dimensions of said rectangular board whereby portions of said rectangular board extend beyond each of the other two edge surfaces of said rectangular fibrous layer to define inner surface portions of said board which are adapted to be located in overlapping contiguous engagement with outer surface portions of the boards in adjacent ones of said roofing units in said insulated roof lining, each of said units including an elongated reinforcing bar which is attached to said inner surface of said board, said reinforcing bar having a thickness in a direction transverse to the plane of said board which is less than the thickness of said fibrous layer, said reinforcing bar being embedded within said fibrous layer at a position substantially parallel to and substantially equidistant from two opposing edge surfaces of said fibrous layer, and the length of said reinforcing bar being substantially equal to the distance between the other two opposing edge surfaces of said fibrous layer.

2. The structure of claim 1 wherein said board is fabricated of wood, the rectangular face of said comparatively soft fibrous layer which is remote from said board being covered by a layer of aluminum foil.

* * * * *